United States Patent [19]

Brunet et al.

[11] 4,256,049

[45] Mar. 17, 1981

[54] DEVICE FOR ASSEMBLING FLOATING BOX CAISSONS

[75] Inventors: Roger Brunet, La Seyne-Sur-Mer; Gérard Marenco, Six-Fours-Les-Plages, both of France

[73] Assignee: Constructions Navales et Industrielles de la Mediterranee, La Seyne-sur-Mer, France

[21] Appl. No.: 897,161

[22] Filed: Apr. 17, 1978

[30] Foreign Application Priority Data

Apr. 27, 1977 [FR] France ..... 77 12714

[51] Int. Cl.[3] ..... B63B 3/02

[52] U.S. Cl. ..... 114/77 R; 114/249

[58] Field of Search ..... 280/504, 505, 508, 509, 280/514, 515, DIG. 8; 213/88, 89, 90; 403/43, 44, 45, 46, 47, 48, 316, 317; 296/35 R; 114/49, 77 R, 77 A, 242, 247, 248, 249, 250, 251, 252

[56] References Cited

U.S. PATENT DOCUMENTS

| | | | |
|---|---|---|---|
| 260,366 | 7/1882 | Burr | 403/45 X |
| 2,113,338 | 4/1938 | Wohldorf | 280/508 |
| 2,597,096 | 5/1952 | Harris | 280/509 |
| 3,430,601 | 3/1969 | Thompson | 114/247 |
| 3,753,591 | 8/1973 | Pratt | 280/DIG. 8 X |
| 3,756,184 | 9/1973 | Hutto | 114/251 |

FOREIGN PATENT DOCUMENTS

| | | | |
|---|---|---|---|
| 436704 | 12/1925 | Fed. Rep. of Germany | 280/509 |
| 1756934 | 10/1970 | Fed. Rep. of Germany | 403/45 |
| 391960 | 1/1974 | U.S.S.R. | 114/249 |

*Primary Examiner*—Charles E. Frankfort

*Attorney, Agent, or Firm*—Wenderoth, Lind & Ponack

[57] ABSTRACT

A device for assembling and locking floating box caissons, which includes, on the caissons faces to be assembled, a pre-locking system disposed at the corners of the caisson and comprising a lock-type male system on one caisson, and a hook-type female system on the other caisson. Such pre-locking system is designed for producing automatically the pre-locking of the assembled caissons. A manual positive locking system is disposed in the central positions of the caissons for completely locking the two caissons together.

5 Claims, 5 Drawing Figures

DEVICE FOR ASSEMBLING FLOATING BOX CAISSONS

BACKGROUND AND SUMMARY OF THE INVENTION

The present invention relates to a device for rapidly and safely assembling, under pre-locking and locking conditions, a pair of floating box caissons, even under extremely difficult conditions such as a strong current.

A device according to this invention is characterized essentially in that it comprises, on the surfaces of the caissons to be assembled, on the one hand pre-locking means disposed preferably at the corners of the caissons and comprising on one caisson a bolt-type male system and on the other caisson a hook-type female system. This pre-locking means is capable of automatically pre-locking, with a substantial degree of play, the caissons to be assembled. On the other hand the device includes positive locking means, disposed preferably in the central portions of the caissons, for completely locking the two caissons together.

According to a feature characterizing this invention the pre-locking means comprise for the female system a casing provided in its inner portion with a pre-locking hook and a control mechanism, and for the male system a lock bolt provided with a central bore adapted to be engaged by the hook when the caissons to be assembled are brought toward each other.

According to another feature characterizing this invention the pre-locking hook is locked in the hole of the corresponding bolt through the medium of a movable stop member.

According to a still further feature characterizing this invention the lock means proper comprise on one caisson a number of bolts adapted to pivot about pins and projecting from the caisson surface, such bolts being inter-connected in pairs by means of springs urging the bolts towards each other, the end of the opposite caisson being provided with apertures registering with the bolts of the first caisson, whereby, when the caissons are moved towards each other, the bolts of one caisson penetrate into the apertures of the other caisson. In addition, movable lock beams responsive to a control screw are mounted in the caisson provided with the apertures and register with the latter in order to lock each bolt in the caisson in a locking position.

BRIEF DESCRIPTION OF THE DRAWINGS

Other features and advantages of this invention will appear from the following description, with reference to the accompanying drawings illustrating diagrammatically by way of example a typical embodiment of the invention, and wherein.

DETAILED DESCRIPTION OF THE INVENTION

Figure 2:
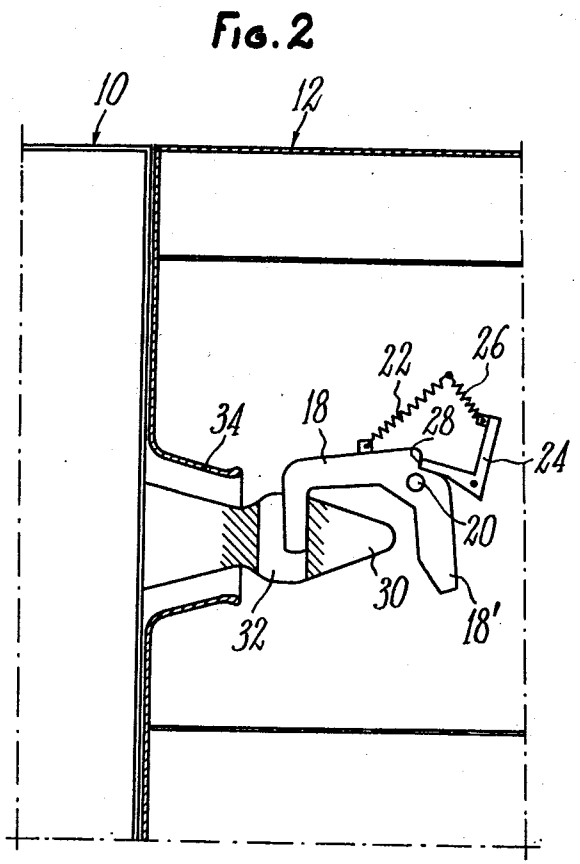
FIG. 2 is a view similar to FIG. 1, but illustrating the pre-locking means in positions thereof after assembling the two caissons.
Figure 1:
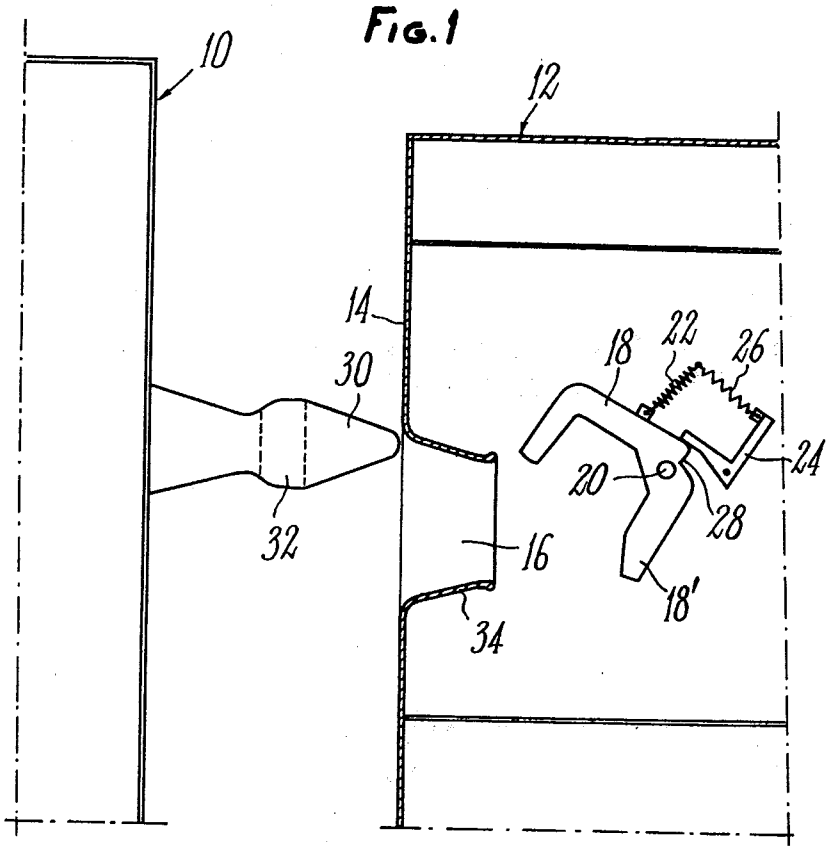
FIG. 1 is a fragmentary section and partial elevational view of the pre-locking means of the invention, shown in positions before assembling two caissons.

Referring first to FIGS. 1 and 2, there is shown diagrammatically at 10 and 12 a pair of floating box caissons to be assembled, of which only the corners comprising the pre-locking means are visible.

As already mentioned hereinabove, the pre-locking means are in the form of a male system on the left-hand caisson, as seen in FIGS. 1 and 2, and of a matching female system on the right-hand caisson, these systems being such that the two caissons can be assembled without having to precisely align them beforehand. These pre-locking means are adapted to perform automatically a first mutual engagement with a relatively large play so that the subsequent positive locking phase can be performed very easily.

These pre-locking means comprise:

(a) for the female portion, a casing 14 provided with an aperture 16 and enclosing a pre-locking hook member 18 fulcrumed at 20 and urged by a spring 22 to the position of FIG. 1. Also enclosed in casing 14 is a member 24 for controlling the hook 18 and consisting of a movable stop following the pivoting movement of hook 18, another spring 26 constantly urging such stop into engagement with the hook until the stop drops into a notch 28 formed in hook 18 (FIG. 2) to lock hook 18 in a pre-locking position.

(b) for the male portion, a fixed bolt 30 in which a central transverse bore 32 is formed.

The aperture 16 formed in the wall of casing 14 is provided with an inner wall extension 34 of frustoconical configuration to facilitate the introduction of bolt 30 into the casing 14, even when the caissons are out of alignment to a substantial degree. When the bolt 30 is ready for engagement into the aperture 16, the two caissons 10 and 12 are caused to move toward each other by actuating the corresponding propulsion means, the bolt 30 then penetrating into the aperture 16. During this penetration, the bolt 30 engages the lever or end 18' connected to hook 18 mounted in the casing, thus causing the hook 18 to tilt about fulcrum 20, whereby the end of hook 18 opposite to end 18' penetrates into the hole 32 of bolt 30. At the same time, the movable stop 24 urged by spring 26 follows the angular movement of hook 18 and at the end of this movement engages the notch 28 thereof, thus locking the pre-locking device.

This device can be released by simply raising manually the movable stop 24, so that the spring 22 will automatically move the hook 18 to its release position shown in FIG. 1.

The above-described pre-locking means are designed with a view to perform the pre-locking of a pair of caissons characterized by a considerable degree of misalignment. They are capable, notably, of causing the pre-locking of caissons having a horizontal misalignment of the order of +300 mm and −250 mm and a considerable angular divergence between their adjacent sides.

When the caissons are locked, no stress is transmitted through the locking means due to the excess diameter of bore 32.

Now the means for positively locking the caissons will be described. Of course, this positive locking action can only take place if the two floating box caissons have previously been brought together and pre-locked by means of the above-described pre-locking device, so that the relative movements between the two caissons are extremely reduced.

According to this invention, this positive locking action is performed manually so that a very rigid coupling can be obtained under the safest conditions between the two caissons, this coupling permitting for example the utilization of a series of assembled and interlocked caissons such as a continuous girder constituting a runway of a floating bridge.

Figure 3:
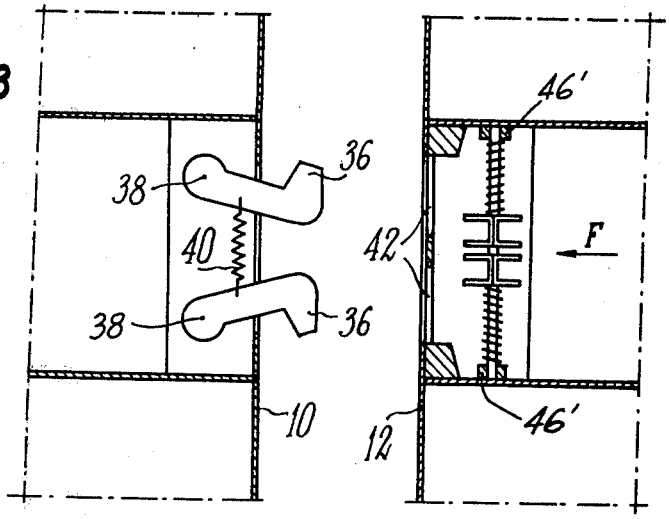
FIG. 3 is a partial section illustrating the positive locking means of the invention before assembling the caissons.
Figure 4:
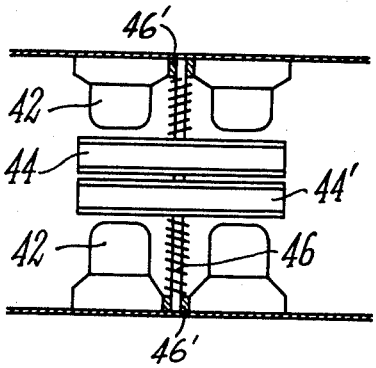
FIG. 4 is a view taken in the direction of the arrow F of FIG. 3.
Figure 5:
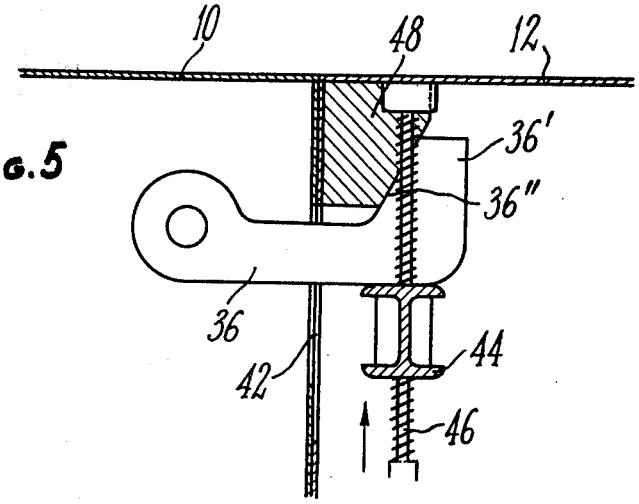
FIG. 5 is a fragmentary view showing on a larger scale the positive locking means in their final locking position.

Referring to FIGS. 3 to 5, it will be seen that an end face of caisson 10 comprises in its central portion (constituting a reinforced area through which the stresses are transmitted) a locking unit comprising a number of movable bolts 36 pivoted to pins 38 and projecting from the caisson end face. These bolts 36 are interconnected in pairs by means of a spring 40 tending in the inoperative position to urge the bolts 36 of each pair towards each other, as shown in FIG. 3.

Registering with the first caisson 10 is another caisson 12 which is to be coupled and which has formed in its end wall a plurality of apertures 42 corresponding to the lock bolts 36 of caisson 10, so that when the caissons are moved towards each other the lock bolts 36 of one caisson penetrate into the apertures 42 of the other caisson.

Mounted in the caisson 12 are an upper beam 44 and a lower beam 44'. These beams are movable under the control of a screw 46 to which access can be had from the top of the caisson. As clearly shown in FIG. 4, this screw has one portion formed with left-hand threads and another portion formed with right-hand threads, so that when the screw is rotated the upper beam 44 rises and the lower beam 44' is lowered.

When the caissons 10, 12 are in mutual contact, the upper beam 44, during its upward movement, engages the head of upper bolt 36 and raises the latter until it bears with its end 36' in locking engagement with contact face 36'' formed on a block 48 secured to the frame structure of the caisson (FIG. 5). The same movement is obtained at the same time with the lower beam 44' wedging the lower bolt 36 against a matching contact block rigid with the caisson structure and similar to the block 48 engaged by the upper bolt.

It may be noted that the same screw 46 controls the simultaneous movements of the pair of beams 44, 44' for wedging the pair of bolts 36. The beams 44, 44' are mounted on the screw but are allowed to pivot somewhat about the longitudinal axis of bolt 46 in order to distribute the stresses to the respective pairs of bolts associated therewith.

According to this invention, the surfaces 36'' of the bolts which engage the contact faces of blocks 48 are inclined so that the clamping effort produced by rotating the screw 46 tends to move the caissons towards each other and thus provide a rigid, play-free assembly.

The ends of screw 46 are mounted with a relatively substantial axial play in the caisson structure, e.g. by means of bushings 46' shown schematically in the drawings, so that the two lower and upper bolts can be wedged or locked simultaneously, even if one of them is locked before the other. The "floating" mounting of this screw 46 further affords a constant play take-up and does not require any re-adjustment in case of wear.

The above-described locking device is such that from pre-locked caissons having a certain degree of slack between them a rigid assembly can be obtained in order to constitute a floating girder on which loads can be carried.

The stresses induced in actual service are transmitted through the locks, and shearing stresses are transmitted by interfitting members that are no part of the present invention. The number of lock bolts 36 to be disposed side by side will thus depend on the stress calculated at the level of the junctions of the caissons.

Of course, many modifications and changes may be made to the embodiment of the invention shown and described herein, without departing from the basic principles thereof as set forth in the appended claims.

What I claim is:

1. A system for coupling and locking a pair of floating box caissons, said system comprising:

a pair of pre-locking means, adapted to be positioned at corners of first and second caissons to be coupled and locked, for automatically achieving a first mutual engagement between said caissons when said caissons are moved toward each other, each said pre-locking means comprising:

a lock bolt extending outwardly from said first caisson, said lock bolt having therethrough a bore;

a casing on said second caisson, said casing having an aperture positioned to confront said lock bolt when said caissons are moved together;

a hook pivotally mounted within said casing; and control means, connected to said hook, for, upon said lock bolt being extended through said aperture, causing said hook to penetrate into said bore through said lock bolt and be locked therein, thereby causing said first mutual engagement between said caissons; and manually operable positive locking means, adapted to be positioned on said first and second caissons at locations centrally between said pair of pre-locking means, for, after said pair of pre-locking means achieve said first mutual engagement between said caissons, achieving a manually removable locking second mutual engagement between said caissons, said positive locking means comprising, on one of said caissons, at least one pair of upper and lower locking bolts pivotally mounted about respective horizontal axes between an unlocked position whereat said upper and lower bolts are relatively adjacent each other and a locked position whereat said upper and lower bolts are relatively spaced from each other, and spring means for biasing said upper and lower bolts to said unlocked position, and on the other of said caissons, upper and lower apertures positioned to register with said upper and lower bolts when in said unlocked position, whereby said upper and lower bolts penetrate said upper and lower apertures when said caissons are moved together, a vertically extending control screw mounted within said other caisson, upper and lower locking blocks within said other caisson at positions to be contacted by said upper and lower bolts, respectively, when said upper and lower bolts are in said locked position, and upper and lower horizontally extending beams threaded onto said control screw, such that rotation of said control screw moves said upper and lower beams against the force of said spring means upwardly and downwardly, respectively, into contact with said upper and lower bolts, respectively, thereby moving said upper and lower bolts to said locked position and pressing said upper and lower bolts into engagement with said upper and lower locking blocks, respectively.

2. A system as claimed in claim 1, further comprising a frusto-conical guide means, extending inwardly of said casing from said aperture, for guiding said lock bolt during movement of said lock bolt through said aperture.

3. A system as claimed in claim 1, wherein said control means comprises a pivot mounting said hook for movement between a first open position and a second locking position, spring means for biasing said hook to said first open position thereof, a lever rigidly connected to said hook and positioned to be abutted by said lock bolt upon movement of said lock bolt into said casing, whereupon said hook pivots to said second locking position penetrating through said bore, and stop means biased against said hook to maintain said hook in said second locking position against the force of said spring means.

4. A system as claimed in claim 1, wherein said control screw is vertically movable to equally distribute the locking force of said upper and lower beams.

5. A system as claimed in claim 1, wherein said bolts and said locking blocks have mutual inclined abutting surfaces.

* * * * *